United States Patent [19]

Miffitt et al.

[11] 4,169,588

[45] Oct. 2, 1979

[54] ELECTRONICALLY CONTROLLED EXERCISING MACHINE

[75] Inventors: Donald C. Miffitt, Chelmsford; Angelo Tortola, Waltham, both of Mass.

[73] Assignee: The Gillette Company, Boston, Mass.

[21] Appl. No.: 857,374

[22] Filed: Dec. 5, 1977

[51] Int. Cl.[2] ..... A63B 23/04

[52] U.S. Cl. ..... 272/70; 272/100; 273/86 B

[58] Field of Search ..... 35/11 R, 22 R; 73/379; 272/70, 129, DIG. 5, DIG. 6, 73, 69; 273/1 E, 86 B; 340/323 R

[56] References Cited

U.S. PATENT DOCUMENTS

| | | | |
|---|---|---|---|
| 3,375,717 | 4/1968 | Impellizzeri et al. | 73/379 |
| 3,454,942 | 7/1969 | Chamberlin | 272/DIG. 6 |
| 3,580,083 | 5/1971 | Zipser | 272/100 X |
| 3,770,269 | 11/1973 | Elder | 273/1 E |
| 3,802,698 | 4/1974 | Burian et al. | 272/129 X |
| 3,834,702 | 9/1974 | Bliss | 273/86 B |
| 3,984,666 | 10/1976 | Barron | 73/379 X |
| 4,066,239 | 11/1977 | Pfleiderer et al. | 272/DIG. 6 |

*Primary Examiner*—Vance Y. Hum

*Attorney, Agent, or Firm*—Richard A. Wise; Raymond J. Devellis

[57] ABSTRACT

Electronic game apparatus is provided which is controlled by a person jogging in place to establish a simulated race between a jogger and a simulated competitive runner on the face of a display. The simulated figures give an indication of accumulated input pulses between the jogger and the set rate of the electronic controls.

10 Claims, 2 Drawing Figures

ELECTRONICALLY CONTROLLED EXERCISING MACHINE

BACKGROUND OF THE INVENTION

This invention relates to an electronic exercising machine which is directly controlled by a person running or jumping in place, or indirectly controlled such as by use of a standing bike or the like. More particularly, this invention is directed toward an exercising machine which is electronically controlled and does not require complex, costly and unreliable devices to simulate competition.

Jogging is accepted today as an ideal form of exercise. For most persons, however, it is not practical actually to jog out of doors each day, and most persons resort to jogging in place within their homes. However, even though jogging in place is an excellent exercise, it is difficult for most persons to continue day after day conscientiously to carry out the exercise. This is because the exercise itself is boring and there are no competitive incentives of an immediate nature so as to cause a person to continue the program even though he or she may realize that one should, from a health and fitness standpoint. This invention introduces an element of competitiveness into the exercise of jogging in place, and thereby transforming the exercise into an exciting and enjoyable game.

A jogging game apparatus as shown in U.S. Pat. No. 3,834,702, includes a plurality of motor drives and a complex three dimensional game board. Further, the competitive aspect of such a game required a set time limit between the start and finish of the exercise.

Electronic jogging game apparatus as shown in U.S. Pat. No. 3,580,083, is not directed toward simulating a competitive situation. Further, such apparatus measured the rate of speed and/or absolute distance covered by a person running in place but not the cumulative rate of the jogger. Displaying the cumulative rate of the jogger is believed to be important from the competitive point of view of the user of the exercising machine.

The present invention provides a device overcoming the difficulties associated with mechanical drives and complex displays while providing a cumulative rate indication of the jogger with respect to a preset rate of the exercise device.

In a preferred embodiment of this invention, a display consisting of two dimensional figures representing the jogger and the machine gives an indication of the cumulative input pulses between the jogger and the set rate of the machine.

SUMMARY OF THE INVENTION

It is an object of this invention to provide an electronically driven exercise game which is straightforward and utilizes a competitive display.

It is another object of this invention to provide an electronic jogging device which will give a visual indication to the jogger if he or she is ahead, in phase, or behind a reference jogger, on a cumulative basis.

It is a further object of this invention to provide electronic circuitry for controlling on a cumulative basis a simulated race.

It is still a further object of this invention to provide an electronic exercising device which is competitive in nature and without fixed time limits.

Briefly stated, and according to an aspect of this invention, the foregoing objects are achieved by providing circuitry which comprises constant current source-drain means which charge and discharge an associated accumulator means at a pre-selected rate to control a simulated jogger figure in accordance with the cumulative rate of the user and in competition with a preset simulated reference figure.

BRIEF DESCRIPTION OF THE DRAWINGS

The invention both as to its organization and principles of operation together with further objects and advantages thereof may better be understood by referring to the following detailed description of an embodiment of the invention taken in conjunction with the accompanying drawings, in which.

DESCRIPTION OF THE PREFERRED EMBODIMENT

Figure 1:
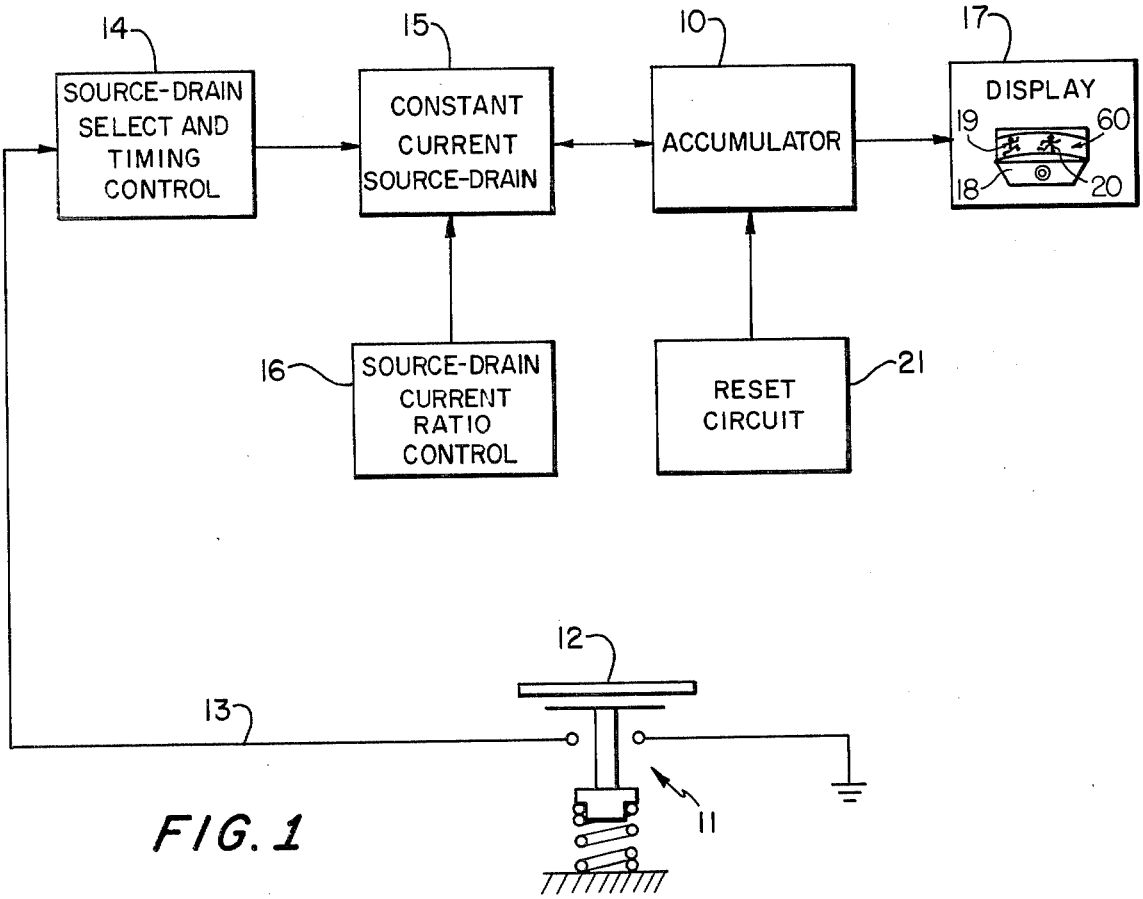
FIG. 1 is a block diagram of the system, in accordance with this invention.

Referring now to FIG. 1, the jogger would control a jogger character directly by means of one or more spring loaded switches such as switch 11 located under a mat 12 on which the jogger carries out his jogging in place exercises or indirectly through the use of a standing bike or the like modified to close the switch 11 such as once a revolution. The switch 11 is electrically connected through a line cord 13 or the like to the source-drain select and timing control circuit 14.

The source-drain select and timing control circuit 14 is electrically connected at its output to a first input terminal to constant current source-drain circuit 15 to signal the constant current source-drain circuit 15 to ultimately generate a control signal.

Electrically connected to a second input terminal of the constant current source-drain 15 is source-drain current ratio control circuit 16. The source-drain current ratio control circuit 16 selects the current source-drain ratio for the desired input frequency of the control signal of the constant current source-drain circuit 15. An accumulator circuit 10 is electrically connected between the constant current source-drain circuit 15 and a display means 17.

The accumulator 10 stores information of the up-to-date control signal from the output of the constant current source-drain circuit 15 and includes a voltage signal indicative of the average or cumulative rate of speed of the jogger on the mat displayed constantly by meter 18 of display means 17.

Disposed behind a face portion 60 of meter 18 is a simulated jogging character figure 19 which is fixed on a permanent magnet moving coil mechanism such as that of a d'Arsonval movement, commonly used in ampmeters and volt meters. A reference jogger character or figure 20 appearing on the inside of face 60 of meter 18 may be set anywhere along the face 60 but is usually set proximate to the middle of face 60 of meter 18. The controlled jogger character 19 is thereby simulated as lagging behind reference character 20 (as depicted in FIG. 1), in phase with character 20 when positioned approximately behind the character 20, or leading character 20. These figures or characters 19 and 20 are two dimensional figures and include no tracks or the like and require no start or finish indication on the display and hence no time limit of exercise by the jogger.

Electrically connected to an input terminal of the accumulator 10 is a reset circuit 21. In general, the reset circuit 21 initializes the accumulator circuit 10 at the beginning of an exercise.

Figure 2:
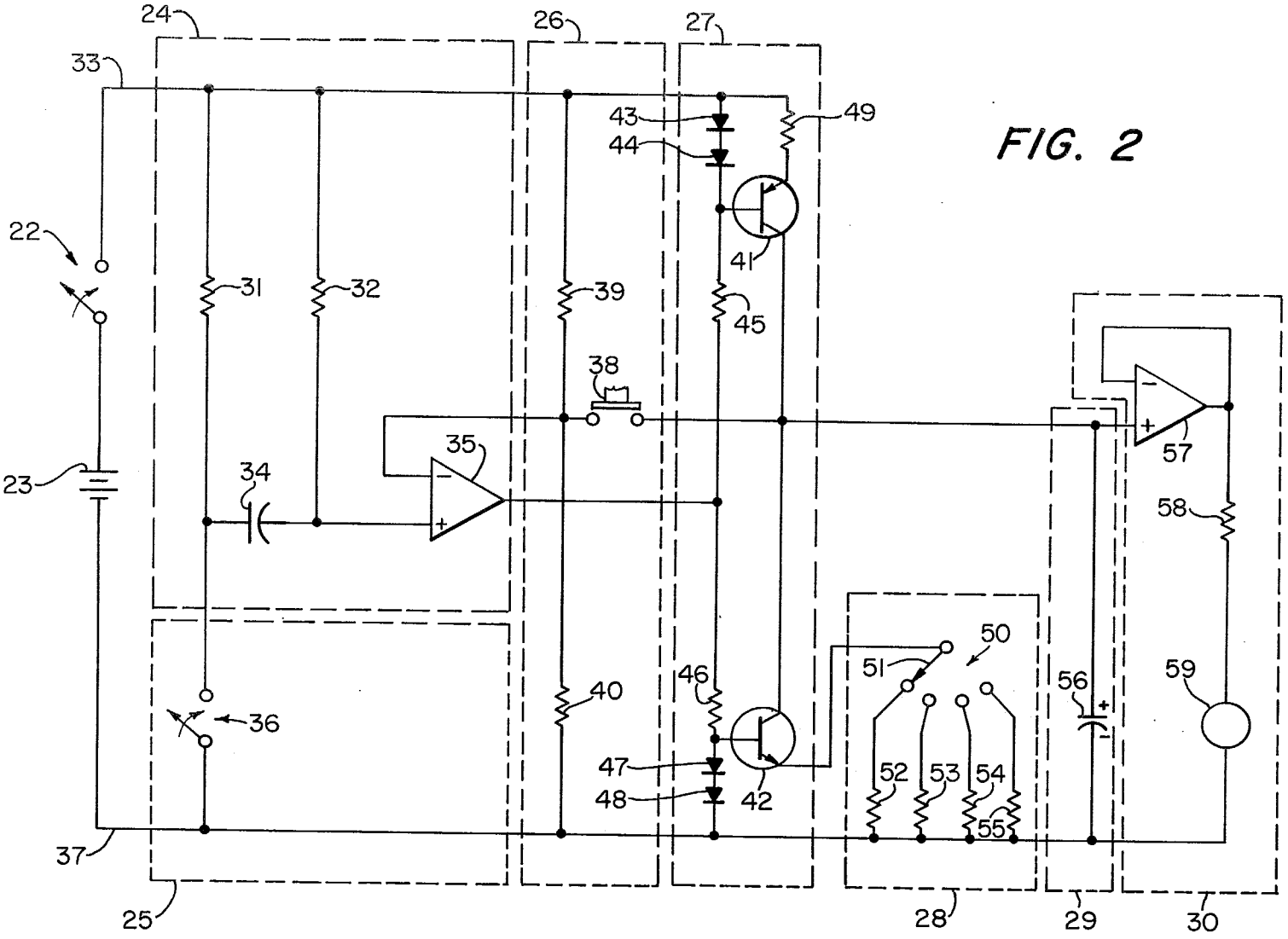
FIG. 2 is a circuit diagram of the system of FIG. 1 in accordance with this invention.

Referring now to the circuit description of FIG. 2, a power switch 22 is illustrated as electrically connected in series to a power source 23. Power source 23 may take the form of a battery of 9 volts. The power switch 22 is depicted as a single pole single throw switch. When the power switch 22 is in its on or closed position, power is applied to the system. The system includes source-drain select and timing control circuit 24, mat circuit 25, reset circuit 26, constant current source-drain circuit 27, source-drain current ratio control 28, accumulator circuit 29, and display circuit 30.

The source-drain select and timing control circuit 24 includes resistor 31 and resistor 32 both electrically connected at an end to upper conductor 33, which in turn is electrically connected to power switch 22. Connected between the other ends of resistor 31 and 32 is capacitor 34. The junction of resistor 32 and capacitor 34 is electrically connected to the positive input terminal of operational amplifier 35. The operational amplifier 35 is of type quad LM324 and available from a variety of manufacturers. Capacitor 34 has a value of 0.22 microfarads at 16 volts. Resistors 31 and 32 are both one-half watt, 10,000 ohms resistors. Resistor 32, capacitor 34, and operational amplifier 35 form a one-shot multivibrator. Resistor 31 functions as a reference resistor to keep the capacitor 34 at a positive voltage.

Mat circuit 25 may take a variety of forms to generate input pulses to the system. In this embodiment it includes a switch 36 such as a foot-operated switch, which makes and breaks contact depending upon the pressure on an associated mat as is well known in the art. One side of the switch 36 is electrically connected to source-drain select and timing control circuit 24 and the other side of switch 36 is electrically connected to a lower conductor 37. Switch 36 is a single pole normally open switch.

Reset circuit 26 includes a normally open reset switch 38 electrically connected to the negative input terminal of operational amplifier 35 in source-drain select and timing control circuit 24 at one of its contacts and to the constant current source-drain circuit 27 at its other contact. Resistor 39 is electrically connected between upper conductor 33 and the junction of reset switch 38 and the negative input terminal of operational amplifier 35. A resistor 40 is electrically connected between the same junction point and lower conductor 37.

Constant current source-drain circuit 27 includes a PNP transistor 41 and a NPN transistor 42 connected with common collectors. The junction of the common collectors is electrically connected to a side of reset switch 38. The emitter of transistor 41 is electrically connected through resistor 49 to a junction point of conductor 33 and series connected diodes 43 and 44 which in turn are electrically connected to the base of transistor 41. Resistor 49 is a one-quarter watt, 100,000 ohms resistor and may be adjustable. Transistor 41, diodes 43 and 44 and resistors 45 and 49 form a constant current source as is well known in the art.

Electrically connected between the base of transistor 41 and the output of operational amplifier 35 in the source-drain select and timing control circuit 24 is a one-half watt, 10,000 ohms resistor 45. This junction is further electrically connected to resistor 46 of one-half watt, 10,000 ohms which is in turn connected to the base of transistor 42. Connected between the base of transistor 42 and the lower conductor 37 is a series connection of diodes 47 and 48. Transistor 42, diodes 47 and 48 and resistor 46 and the chosen resistance value of the source-drain ratio control 28 form a constant current drain as is well known in the art. Transistor 41 is of type 2N3906 and transistor 42 is of type 2N3904. All diodes are of type 1N4148.

Source-drain current ratio control circuit 28 includes a five-pole rotary switch 50 electrically connected to the emitter of transistor 42 in the reset circuit 27. Depending upon the position of the wiper arm 51 of switch 50, an electrical connection is made to either resistor 52, 53, 54, or 55, and lower conductor 37. It is possible to substitute a potentiometer for the source-drain current ratio control circuit 28. The values of resistors 52 through 55 may be chosen for convenience and in a range such as resistor 52 at 100,000 ohms, resistor 53 at 300,000 ohms, resistor 54 at 500,000 ohms, and resistor 55 at 100,000,000 ohms.

The accumulator circuit 29 includes a capacitor 56 such as a 47 microfarad 16 volt capacitor. The positive side of capacitor 56 is electrically connected to a junction point in common with the common collectors of transistors 41 and 42 and to a positive input terminal of operational amplifier 57. The negative side of capacitor 56 is electrically connected to lower conductor 37.

The display means 30 includes an operational amplifier 57 having its output electrically connected in feedback to its negative input terminal and in series with resistor 58, meter 59, and lower conductor 37. Operational amplifier 57 is of the quad LM324 type. Resistor 58 may be adjustable and of a value such as 100,000 ohms. The meter 59 is a one milliampere full scale deflection type meter. Further, an electrical connection is present between the junction of the common collectors of transistors 41 and 42 in the reset circuit 27 and the positive input terminal to operational amplifier 57.

In operation, a closure of the mat switch 36 triggers the one shot multi-vibrator made up of capacitor 34, resistor 32, and operational amplifier 35. The constant current source formed by transistor 41, diodes 43 and 44, and resistors 49 and 45 is turned on thereby charging capacitor 56 for a time equal to the RC time constant of resistor 32 and capacitor 34.

When a pulse is present at the output of operational amplifier 35, the constant current source is on and the constant current drain is off and capacitor 56 is charging in a linear manner. When there is no pulse present at the output of operational amplifier 35, the source is off and the drain is on and therefore capacitor 56 is decreasing in voltage in a linear manner. In order to keep the voltage across capacitor 56 constant, one must increase the pulse input rate to average that of the rate of drain.

When transistor 41 is no longer conducting, capacitor 56 is discharged by the constant current drain formed by transistor 42, diodes 47 and 48, resistor 46, and the chosen resistor (52 through 55) in source-drain current ratio control circuit 28. The discharge or capacitor 56 is determined by selecting one of the resistors 52 through 55. The amount of charge in capacitor 56 is read at all times by the display meter 59 which is buffered by integrated circuit 57.

As long as the collector or transistor 41 is below 6 volts, transistor 41 will conduct and capacitor 56 will charge. When transistor 41 is no longer conducting, capacitor 56 discharges at a constant rate by turning on transistor 42 which acts as a constant current drain. The charge is removed from capacitor 56 at a preset rate, set by the switch 50 which introduces one of varying resistors in the drain source circuit.

Every time the system is turned on or a new exercise time is required, a reset pulse is provided by activating the normally open switch 38 in reset circuit 26.

While an embodiment and application of this invention has been shown and described, it will be apparent to those skilled in the art that many more modifications are possible without departing from the inventive concepts herein described. The invention, therefore, is not to be restricted except as necessary by the prior art and by the spirit of the appended claims.

What is claimed as new and desired to be secured by Letters Patent of the United States is:

1. An electronically controlled exercising machine comprising:

switching means including a pulse generating means for generating pulses when activated by an exerciser;

display means including a fixed reference character and a movable character;

accumulator means for providing a signal to position said movable character of said display means indicative of the cumulative rate of pulses from said pulse generating means; and circuit means including constant current source-drain circuitry electrically coupled to said switching means and said accumulator means for charging and discharging said accumulator means in a linear manner.

2. The machine as in claim 1, wherein said accumulator means includes a capacitor.

3. The machine as in claim 1, wherein said display means includes a meter having a permanent magnet moving coil mechanism, said movable character being affixed to said mechanism.

4. The machine as in claim 1, further including a source-drain current ratio control circuit electrically connected to said constant current source-drain circuitry for providing a preselected rate for said accumulator means.

5. The machine as in claim 4, wherein said pulse generating means includes a multivibrator circuit.

6. The machine as in claim 5, wherein said switch means is directly controlled by the exerciser.

7. The machine as in claim 1 wherein said pulse generating means controls the charging of said accumulator means during a pulse and said circuit means controls the discharging of said accumulator means in the absence of the pulse.

8. The machine as in claim 1 wherein said circuit means controls the charging of said accumulator means during the absence of a pulse and said pulse generating means controls the discharging of said accumulator means during the pulse.

9. An electronically controlled exercising machine comprising:

switching means including a pulse generating means for generating pulses when activated by an exerciser;

display means including a fixed reference character and a movable character;

accumulator means including a capacitor for providing a signal to position said movable character of said display means indicative of the cumulative rate of pulses from said pulse generating means; and circuit means including constant current source-drain circuitry electrically coupled to said switching means and said accumulator means for charging and discharging said accumulator means in a linear manner, wherein said pulse generating means controls the charging of said accumulator means during a pulse and said circuit means controls the discharging of said accumulator means in the absence of the pulse.

10. An electronically controlled exercising machine comprising:

switching means including a pulse generating means for generating pulses when activated by an exerciser;

display means including a fixed reference character and a movable character;

accumulator means including a capacitor for providing a signal to position said movable character of said display means indicative to the cumulative rate of pulses from said pulse generating means, and circuit means including constant current source-drain circuitry coupled to said switching means and said accumulator means for charging and discharging said accumulator means in a linear manner, wherein said circuit means controls the charging of said accumulator means during the absence of a pulse and said pulse generating means controls the discharging of said accumulator means during the pulse.

* * * * *